US009384890B2

(12) United States Patent
Sagawa et al.

(10) Patent No.: US 9,384,890 B2
(45) Date of Patent: Jul. 5, 2016

(54) POWDER-FILLING SYSTEM

(71) Applicants: INTERMETALLICS CO., LTD., Nakatsugawa-shi, Gifu (JP); DAIDO STEEL CO., LTD., Nagoya-shi, Aichi (JP)

(72) Inventors: Masato Sagawa, Kyoto (JP); Osamu Itatani, Kyoto (JP); Norio Yoshikawa, Nagoya (JP)

(73) Assignees: INTERMETALLICS CO., LTD., Nakatsugawa-shi (JP); DAIDO STEEL CO., LTD., Nagoya-shi (JP)

( * ) Notice: Subject to any disclaimer, the term of this patent is extended or adjusted under 35 U.S.C. 154(b) by 0 days.

(21) Appl. No.: 14/765,130

(22) PCT Filed: Feb. 3, 2014

(86) PCT No.: PCT/JP2014/052411

§ 371 (c)(1),
(2) Date: Jul. 31, 2015

(87) PCT Pub. No.: WO2014/119778

PCT Pub. Date: Aug. 7, 2014

(65) Prior Publication Data

US 2015/0364252 A1 Dec. 17, 2015

(30) Foreign Application Priority Data

Feb. 4, 2013 (JP) ..... 2013-019891

(51) Int. Cl.
*H01F 41/02* (2006.01)
*B65B 1/04* (2006.01)
(Continued)

(52) U.S. Cl.
CPC ..... *H01F 41/0273* (2013.01); *B22F 3/004* (2013.01); *B30B 15/302* (2013.01); *B65B 1/04* (2013.01); *B65B 1/16* (2013.01); *B65B 7/28* (2013.01); *H01F 41/0266* (2013.01)

(58) Field of Classification Search
CPC ... H01F 41/0273; H01F 41/0266; B65B 1/04; B65B 1/16; B22F 3/004; B30B 15/302
See application file for complete search history.

(56) References Cited

U.S. PATENT DOCUMENTS 6,155,028 A 12/2000 Nagata et al.
6,475,430 B1 * 11/2002 Nagata ..... B30B 11/00 222/197

(Continued)

FOREIGN PATENT DOCUMENTS

CN 102893348 A 1/2013
EP 0 900 645 A2 3/1999

(Continued)

OTHER PUBLICATIONS

Apr. 28, 2014 Written Opinion issued in International Application No. PCT/JP2014/052411.

(Continued)

*Primary Examiner* — Robert B Davis
(74) *Attorney, Agent, or Firm* — Oliff PLC

(57) ABSTRACT

A powder-filling system capable of filling a container with powder at an approximately uniform filling density has: a hopper having an opening removably and hermetically closably attached to the container, the hopper communicating with the container at the opening for supplying powder to a container; a powder supplier for supplying powder to the hopper; a gas supplier for repeatedly supplying compressed gas in a pulsed form to the hopper, with the hopper hermetically closably attached to the container; and a sieve member provided at the opening and having a smaller openings in a region near a side wall of the hopper than in its central region. The smaller openings in the region near the side wall of the hopper where the powder more easily falls from the hopper into the container impedes the fall of the powder in that region and improves the overall uniformity in the filling density.

4 Claims, 7 Drawing Sheets

(51) Int. Cl.

| | |
|---|---|
| ***B65B 1/16*** | (2006.01) |
| ***B22F 3/00*** | (2006.01) |
| ***B30B 15/30*** | (2006.01) |
| ***B65B 7/28*** | (2006.01) |

(56) References Cited

U.S. PATENT DOCUMENTS

| | | | | |
|---|---|---|---|---|
| 6,656,416 | B2 * | 12/2003 | Nakamura | B22F 3/004 419/38 |
| 7,866,312 | B2 * | 1/2011 | Erdmann | F24C 3/12 126/299 D |
| 2007/0102058 | A1 | 5/2007 | Houzego | |
| 2010/0043916 | A1 | 2/2010 | Dahlberg et al. | |
| 2012/0176212 | A1 * | 7/2012 | Sagawa | B22F 3/005 335/302 |
| 2013/0052290 | A1 | 2/2013 | Hayashi | |

FOREIGN PATENT DOCUMENTS

| | | | | |
|---|---|---|---|---|
| EP | 0 988 959 | A2 | 3/2000 | |
| EP | 2 571 035 | A1 | 3/2013 | |
| JP | H11-49101 | A | 2/1999 | |
| JP | H11-90694 | A | 4/1999 | |
| JP | 2000-328102 | A | 11/2000 | |
| JP | 2007-501171 | A | 1/2007 | |
| JP | 3978262 | B2 * | 9/2007 | B30B 15/302 |
| JP | 2008-012741 | A | 1/2008 | |
| JP | 2010-510069 | A | 4/2010 | |
| WO | 2005/014397 | A1 | 2/2005 | |
| WO | 2008/060229 | A1 | 5/2008 | |
| WO | 2011/142321 | A1 | 11/2011 | |

OTHER PUBLICATIONS

Jan. 29, 2016 Extended European Search Report issued in European Application No. 14745964.8.

* cited by examiner

OPENING
A: 8.0×2.0mm
B: 8.0×1.8mm
C: 8.0×1.6mm
D: 8.0×1.4mm

POWDER-FILLING SYSTEM

TECHNICAL FIELD

The present invention relates to a powder-filling system for filling a container with powder.

BACKGROUND ART

When a compact is obtained from a powder material by compressing, sintering or other processes, a powder-filling system for putting powder into a container (shaping container) designed for molding (shaping) the powder is used. In such a powder-filling system, the container must be uniformly filled with powder at a predetermined density. Furthermore, in many cases, the filling density of the powder is required to be higher than the level achieved by simply pouring the powder into the container (this is called the "natural filling"). The operation of filling the container at a higher density than the density achieved by the natural filling is hereinafter called the "dense filling."

As one example of the system for the dense filling, Patent Literature 1 discloses a system which employs the air-tapping method to fill a container with powder. In this system, a hopper having an opening in its lower portion is attached to a powder-filling container in a removable and hermetically closable fashion so that the hopper communicates with the container at the opening. The system also has a powder supplier for supplying powder to the hopper and a gas supplier for supplying compressed gas to the hopper. As the compressed gas, air can be used if the filling powder is a hard-to-oxidize powder. If the filling powder is an easy-to-oxidize powder, inert gas should be used, such as nitrogen or argon gas.

At the opening in the lower portion of the hopper, a planer sieve member having a sieve with a predetermined size of openings is provided. The sieve may consist of a grid mesh, parallel wires (a set of parallel wires arranged with predetermined spacing), perforated plate (a thin plate with a number of punched holes) or the like. The size of the openings of the sieve is adjusted so that the powder to be supplied to the container as a whole will not fall naturally but will fall when pressure is applied by compressed gas in a manner to be described later. Needless to say, the size of the openings of the sieve should be greater than the size of the individual particles forming the powder (which are hereinafter called "powder particles"). If the powder particles are highly cohesive, the size of the openings of the sieve needs to be much greater than the powder particles, since the problem in this situation is to control the passage of aggregates of powder particles rather than individual powder particles. The degree of cohesion of the powder particles depends on the electric charges (static electricity) and magnetism possessed by the powder particles or wetness on the surface of the powder particles, the shape of the powder particles, and other factors. In general, finer powder particles have a higher degree of cohesion.

The powder-filling system of Patent Literature 1 is used as follows: Initially, an amount of powder is supplied from the powder supplier to the hopper. At this stage, the powder does not fall off the hopper, since the size of the openings of the sieve is adjusted in the previously described manner. Next, the hopper is attached to the container and hermetically closed. Subsequently, compressed gas is rapidly charged through a gas introduction port into the space above the powder within the hopper, and after a short period of time, the compressed gas is discharged from the hopper. Such a charge and discharge of the compressed gas is alternately repeated at a frequency of several tens of times per second (several tens of Hz), to repeatedly apply pulsed pressures to the top face of the powder within the hopper by the compressed gas. This operation makes the powder gradually pass through the sieve member and fall into the container. After a sufficient amount of powder is supplied to the container, with the top face of the powder above the sieve member, the hopper is removed from the container. This separates the powder held in the container from the powder remaining in the hopper, with the sieve member as the boundary.

CITATION LIST

Patent Literature

Patent Literature 1: JP 11-049101 A

SUMMARY OF INVENTION

Technical Problem

If such an air-tapping method is used to fill a container with powder, the filling density will vary depending on the position within the container; i.e. the filling density will be non-uniform. Naturally, such a non-uniformity in the density distribution affects various properties of the product of the filling material (shaped object).

The problem to be solved by the present invention is to provide a powder-filling system capable of filling a container with powder at an approximately uniform filling density.

Solution to Problem

The present inventors have studied the cause of the aforementioned non-uniformity of the filling density and as a result have reached the conclusion that the cohesive force of the powder particles contributes to the non-uniformity. Specifically, the probable cause is as follows: The cohesive force is an interaction among powder particles and therefore is lower in a region near the side wall of the hopper than in a central region of the hopper. A stronger cohesive force means a lower level of fluidity. Accordingly, the fluidity of the powder near the side wall of the hopper is higher than that of the powder at the center of the hopper. When a downward pressure by air-tapping is applied to the powder within the hopper having such a state of fluidity, the powder near the side wall of the hopper passes more easily through the sieve member and falls into the container than the powder at the center of the hopper. Consequently, the density distribution within the container will be such that the filling density at a position closer to the side wall of the opening of the hopper is higher than at a position closer to the center and more distant from the side wall.

Accordingly, the present inventors have further studied the configuration of the powder-filling system employing the air-tapping method so as to prevent the occurrence of such a non-uniformity in the filling density, and have reached the present invention.

A powder-filling system according to the present invention developed for solving the previously described problem is a system for filling a container with powder, including:

a) a hopper for holding the powder, the hopper having an opening configured to be attached to the container in a removable and hermetically closable fashion so that the hopper communicates with the container at the opening for supplying the powder to the container;

b) a powder supplier for supplying the powder to the hopper;

c) a gas supplier for repeatedly supplying compressed gas in a pulsed form to the hopper, with the hopper attached to the container in a hermetically closed fashion; and d) a sieve member provided at the opening, the sieve member having smaller openings in a region near a side wall of the hopper than in a central region of the hopper.

The "sieve member" in the present application is a member with a number of openings or holes. The sieve typically consists of, but is not limited to, a number of linear members (e.g. wires) arranged parallel to and intersecting with each other forming square or rectangular openings. For example, the sieve member in the present application also includes a simple sieve member consisted of a number of linear members arranged parallel to (but not intersecting with) each other and a plate-shaped member with a number of holes.

The operation of "repeatedly supplying compressed gas in a pulsed form to the hopper" means repeating the process of charging compressed gas into the hopper and discharging the compressed gas from the hopper. The discharge of the compressed gas may be performed as a forced process using a means for drawing the gas or through a natural process (or leak).

In the powder-filling system according to the present invention, after an amount of powder is supplied to the hopper by the powder supplier, the hopper is attached to the container, whereby the container and the hopper are hermetically closed. Subsequently, compressed gas in a pulsed form is repeatedly supplied to the hopper by the gas supplier to make the powder in the hopper pass through the sieve member and fill the container. Since the sieve member has openings with smaller sizes in the region near the side wall of the hopper than in the central region, the powder particles in the region near the side wall of the opening of the hopper, which have been the cause of the high filling density in the conventional air-tapping, do not easily fall into the container. Consequently, the filling density in the region near the side wall is prevented from being higher, so that the filling density of the powder will be approximately uniform within the entire container.

The container to be filled with the powder may either have only one space (cavity) to be filled with the powder or a plurality of such cavities.

In the case of a container having a plurality of cavities, those cavities are hermetically closed while communicating with a common (single) hopper. By repeatedly injecting and discharging compressed gas into and from the hopper in this state, each cavity is filled with the powder. If such an operation is performed by the conventional air-tapping method, the filling density in a cavity near the side wall of the opening of the hopper will be higher than in a cavity near the center of the hopper due to the same reason as previously described. To overcome this problem, the sieve member having smaller openings formed in the region near the side wall than in the central region of the hopper is used, which impedes the fall of the powder in the region above the cavities near the side wall of the opening of the hopper, whereby the filling density in the cavities located near the side wall of the opening of the hopper is prevented from being higher. Consequently, the filling densities of the powder in the cavities will be approximately equal to each other.

For example, the powder-filling system according to the present invention is suitable for the production of sintered magnets, and particularly, for the production of sintered magnets by a press-less method. The press-less method is a technique in which a sintered magnet is obtained by a process including: filling a container with alloy powder obtained by pulverizing alloy to be used as the material of the sintered magnet (filling process); and magnetically orienting the alloy powder (orienting process) and heating it for sintering (sintering process) while holding the powder in the container without applying pressure. Compared to a pressing method in which the powder is compression-molded after the filling process, the press-less method can improve the magnetic properties of the eventually obtained sintered magnet for two reasons: (i) in the process of orienting the alloy powder within the magnetic field, the particles of the alloy powder can more easily rotate in the direction of the magnetic field, so that a higher degree of orientation can be achieved, and (ii) since it is unnecessary to use a large pressing machine, the processes from the filling through the sintering can be performed within a closed space, so that oxidization can be prevented.

In the case of producing a sintered magnet by such a press-less method, the powder-filling system according to the present invention an be used as a system for filling a cavity with alloy powder. In this case, inert gas should be used as the gas supplied from the gas supplier to the hopper in order to prevent oxidization of the alloy powder.

Thus, a sintered magnet production system according to the present invention includes:

1) a powder-filling device for filling a container with alloy powder to be used as a material of a sintered magnet, the powder-filling device having:

a) a hopper for holding the alloy powder, the hopper having an opening configured to be attached to the container in a removable and hermetically closable fashion so that the hopper communicates with the container at the opening for supplying the alloy powder to the container;

b) a powder supplier for supplying the alloy powder to the hopper;

c) a gas supplier for repeatedly supplying compressed inert gas in a pulsed form to the hopper, with the hopper attached to the container in a hermetically closed fashion; and d) a sieve member provided at the opening, the sieve member having smaller openings in a region near a side wall of the hopper than in a central region of the hopper;

2) an orienting device for orienting the alloy powder by applying a magnetic field to the alloy powder while holding the alloy powder in the container without applying a mechanical pressure;

3) a sintering device for sintering the alloy powder by heating the alloy powder while holding the alloy powder in the container without applying a mechanical pressure; and 4) a casing for containing the powder-filling device, the orienting device and the sintering device in an oxygen-free atmosphere.

By using the powder-filling system according to the present invention in this manner for the production of a sintered magnet by a press-less method, the filling density of the alloy powder in the container will be approximately uniform, so that the properties of the sintered magnet will also be approximately uniform regardless of the position within the sintered magnet.

The sintered magnet production system according to the present invention also allows the container to have either only one space (cavity) to be filled with the alloy powder or to have a plurality of such cavities. In the case of a container having a plurality of cavities, the filling densities of the alloy powder in the cavities will be approximately equal to each other, and the plurality of sintered magnets thereby obtained will also have approximately equal magnetic properties.

Advantageous Effects of the Invention

With the powder-filling system according to the present invention, it is possible to fill a container with powder at an approximately uniform filling density.

With the sintered magnet production system according to the present invention using a powder-filling system according to the present invention, it is possible to obtain a sintered magnet having approximately homogeneous magnetic properties.

BRIEF DESCRIPTION OF DRAWINGS

FIGS. 5A and 5B are a vertical sectional view and a top view of a modified example of the container, while

DESCRIPTION OF EMBODIMENTS

An embodiment of the powder-filling system according to the present invention and that of a sintered magnet production system using this powder-filling system are described using FIGS. 1-9.

Embodiment

(1) Embodiment of Powder-Filling System

Figure 1:
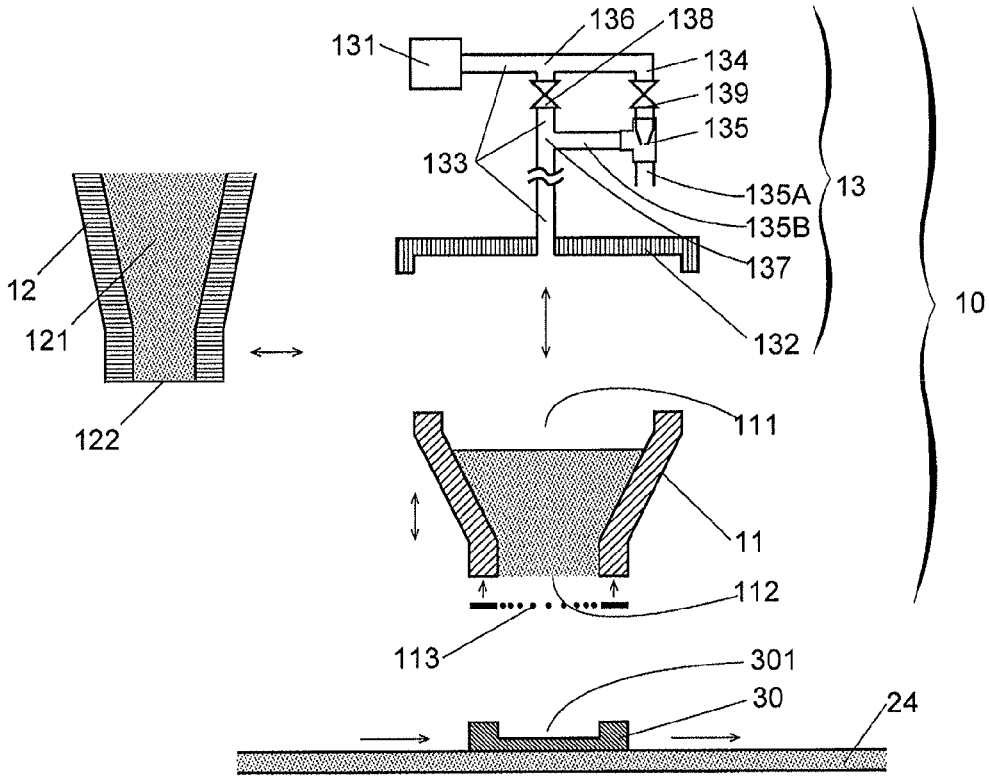
FIG. 1 is a schematic configuration diagram showing one embodiment of the powder-filling system according to the present invention.
Figure 2A:
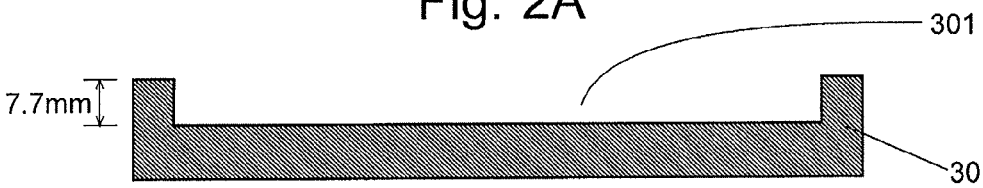
FIGS. 2A and 2B are a vertical sectional view and a top view showing one example of the container to be filled with powder by the powder-filling system of the present embodiment.
Figure 2B:
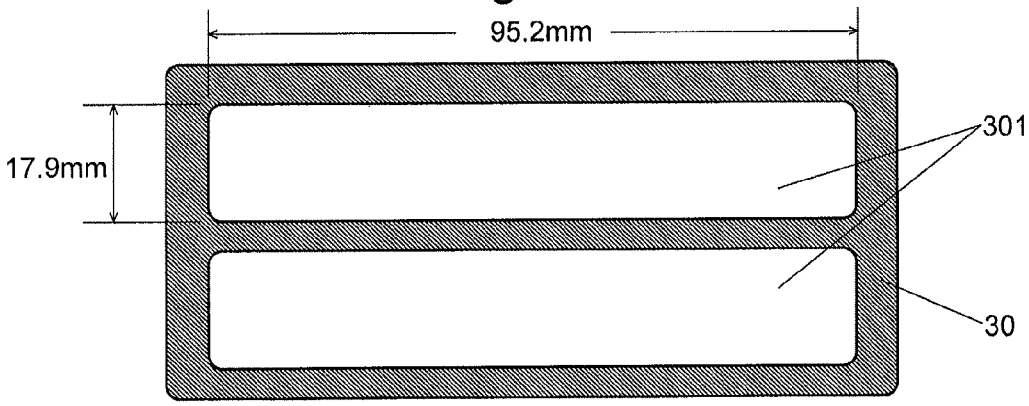

Initially, the powder-filling system 10 of the present embodiment is described. The powder-filling system 10 shown in FIG. 1 is intended to be used in a sintered magnet production system 20 of the present embodiment (which will be described later) to fill a container 30 with alloy powder to be used as the material of a sintered magnet, although it can also be used, without any change, to fill a container with any other type of powder. As shown in FIGS. 2A and 2B, the container 30 used in the present embodiment has two cavities 301 each of which has a roughly rectangular parallelepiped shape measuring 95.2 mm in length, 17.9 mm in width and 7.7 mm in depth and which are arranged side-by-side in their width direction.

(1-1) Configuration of Powder-Filling System 10

The powder-filling system 10 has a hopper 11, a powder supplier 12 for supplying alloy powder to the hopper 11, a gas supplier 13 for supplying compressed gas to the hopper 11, and a moving means (not shown) for moving the hopper 11 to connect or disconnect it to or from the container 30. By a container conveyer 24 (see FIGS. 1 and 6) included in the sintered magnet production system 20 (which will be described later), the container 30 is conveyed to a position directly below the hopper 11 and then transported away from that position.

Figure 3A:
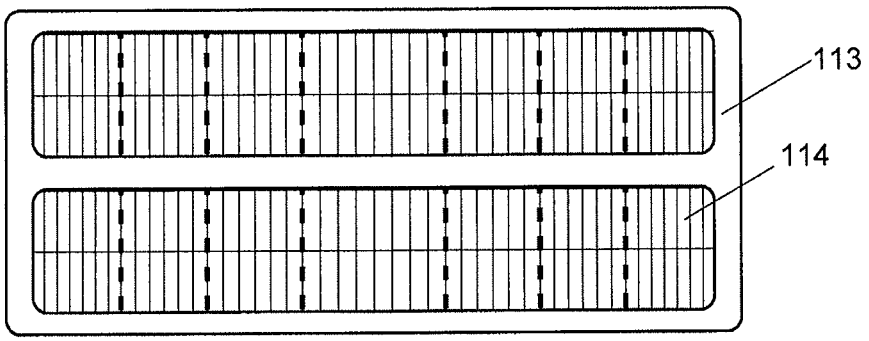
FIG. 3A is a top view showing a sieve member provided in the powder-filling system of the present embodiment.
Figure 3B:
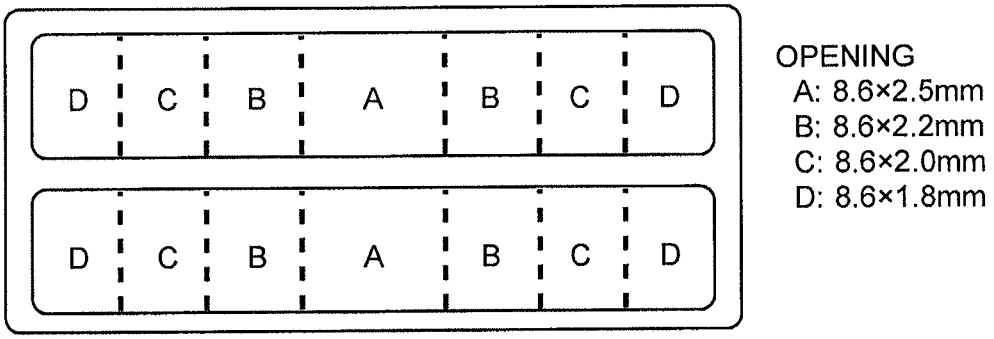
FIG. 3B is a top view of the sieve virtually divided into sections A-D.

The hopper 11 has a funnel-like shape with the horizontal sectional area decreasing from the upper opening 111 toward the lower opening 112. The lower opening 112 of the hopper 11 can be attached to the container 30 in a removable fashion so as to hermetically close the upper side of the container 30. The lower opening 112 has a rectangular shape corresponding to the shape of the top face of the container 30 and is surrounded by the vertical side wall on all sides. A plate-shaped sieve member 113 shown in FIG. 3A is provided at the lower opening 112. The sieve member 113 is a plate member having two roughly rectangular areas (sieve-formed areas) corresponding to the two cavities 301 of the container 30, with a sieve 114 provided in each area. The plate member is made of stainless steel (SUS304). The sieve 114 consists of a large number of roughly rectangular holes (openings) bored in the plate member and arranged in the length and width directions of the sieve-formed areas.

The size of the openings of the sieve 114 is set to be smaller in a region closer to the ends of the long side of the sieve-formed area (a region closer to the side wall of the lower opening 112 of the hopper 11) than in a region closer to the center. Specifically, the sieve 114 is divided into seven virtual sections arranged in the length direction (FIG. 3B), with the virtual section at the center in the length direction labelled as "Section A", the virtual sections on both sides of "Section A" labelled as "Sections B", those on both sides of "Sections B" labelled as "Section C", and those at both extremities in the length direction labelled as "Sections D." The size of the openings of the sieve 114 is 8.6×2.5 mm in Section A, 8.6×2.2 mm in Sections B, 8.6×2.0 mm in Sections C, and 8.6×1.8 mm in Sections D. Compared to the average particle size of the alloy powder used as the material of sintered magnets, which is normally within a range from a few μm to 10 μm, the openings of the sieve 114 are three orders of magnitude greater than the average particle size. However, the alloy powder in the hopper 11 will not easily pass through the openings of the sieve 114 since the particles of the alloy powder aggregate due to their magnetism.

The powder supplier 12 has a storage unit 121 for storing alloy powder and a powder discharge opening 122 for discharging the alloy powder from the lower portion of the storage unit 121. Furthermore, the powder supplier 12 is provided with a moving means (not shown) for moving the powder discharge opening 122 to a position above the upper opening 111 of the hopper 11.

The gas supplier 13 has a compressed-gas source 131 for producing compressed gas, a cover member 132 for hermetically closing the upper opening 111 of the hopper 11, and a gas supply tube 133 (which will be described later). Furthermore, the gas supplier 13 is provided with a moving means (not shown) for moving the cover member 132 so as to attach or detach the cover member 132 to or from the top face of the hopper 11. In the present embodiment, nitrogen gas (which is a kind of inert gas) is used as the compressed gas in order to prevent oxidization of the alloy powder. Inert gas other than nitrogen (e.g. argon), or a mixture of two or more kinds of inert gas may also be used. Air is also available in the case of filling a container with a hard-to-oxidize powder (though not available in the case of producing sintered magnets).

The gas supply tube 133 has one end connected to the compressed-gas source 131 and the other end (closer to the cover) connected to a hole penetrating through the cover member 132. A branch tube 134 extends from a first branching section 136 in the middle of the gas supply tube 133, and an aspirator (ejector) 135 is connected to this branch tube 134. The aspirator 135 consists of a passage tube 135A with a narrowed section in the middle of itself and a suction tube 135B branching from the narrowed section. The pressure within the suction tube 135B can be reduced by passing a stream of compressed gas through the passage tube 135A. The suction tube 135B is connected to the gas supply tube 133 at a second branching section 137 which is closer to the cover member 132 than the first branching section 136. A first valve 138 is provided in the gas supply tube 133 between the first and second branching sections 136 and 137, while a second valve 139 is provided in the branch tube 134.

With the compressed gas being supplied from the compressed-gas source 131 to the gas supply tube 133, if the first valve 138 is opened and the second valve 139 is closed, the compressed gas is ejected from the cover-side end of the gas supply tube 133. Conversely, if the first valve 138 is closed and the second valve 139 is opened, the compressed gas is supplied through the branch tube 134 to the passage tube 135A of the aspirator 135, whereby the pressure within the suction tube 135B is reduced and the gas is suctioned from the cover-side end of the gas supply tube 133 communicating with the suction tube 135B. Accordingly, by alternately and repeatedly opening and closing the first and second valves 138 and 139, it is possible to repeatedly charge the compressed gas and discharge the same gas (and attach the cover) in a pulsed form through the cover-side end of the gas supply tube 133.

(1-2) Operation of Powder-Filling System 10

Figure 4A:
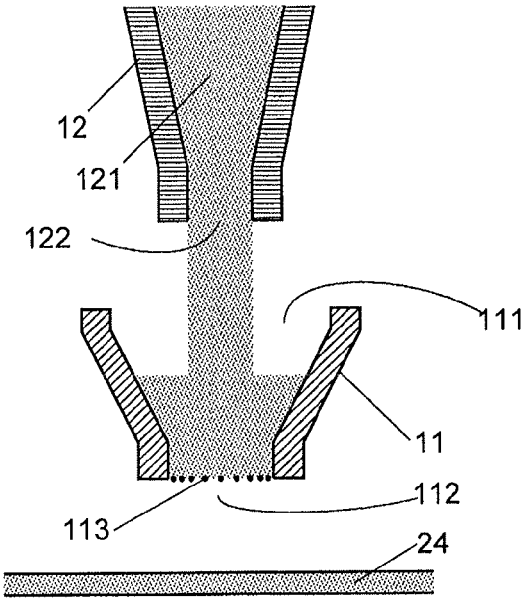
FIGS. 4A-4D are schematic diagrams showing an operation of the powder-filling system of the present embodiment.

An operation of the powder-filling system 10 of the present embodiment is described using FIGS. 4A-4D. First, the powder supplier 12 is moved to a position above the upper opening 111 of the hopper 11 and supplies an amount of alloy powder from the powder discharge opening 122 to the hopper 11 (FIG. 4A). In this step, the alloy powder in the hopper 11 barely falls through the sieve member 133 since the particles of the alloy powder aggregate due to their magnetism. If the alloy powder is previously supplied to the hopper 11 in a sufficiently larger quantity than the capacity of the cavities 301 of one container 30 (e.g. several tens or hundreds of times), this first step can be omitted when the second or subsequent container 30 is to be filled with the alloy powder.

Figure 4B:
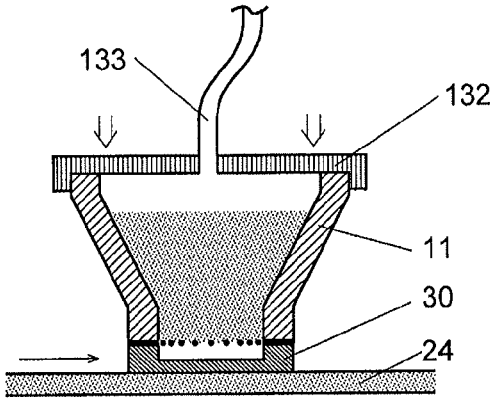

Next, the container 30 is conveyed to a position directly below the hopper 11 by the conveying means. Then, the hopper 11 is lowered to bring its lower side in contact with the container 30 and hermetically close the lower opening 112. Simultaneously, the cover member 132 of the gas supplier 13 is attached to the top face of the hopper 11 to hermetically close the upper opening 111. As a result, the inside of the hopper 11 and the cavities 301 of the container 30 are hermetically closed in a mutually communicating state (FIG. 4B).

Figure 4C:
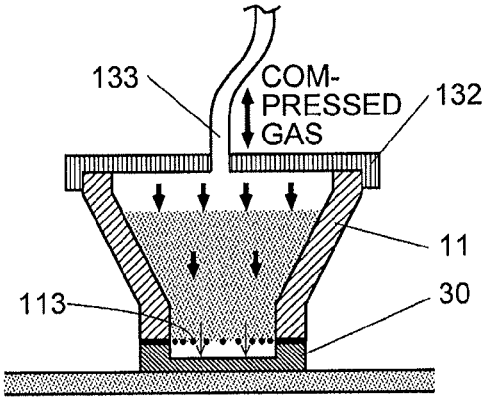

Subsequently, as described earlier, the operation of charging and discharging compressed gas through the cover-side end of the gas supply tube 133 is repeated by alternately and repeatedly opening and closing the first and second valves 138 and 139 while supplying the compressed gas from the compressed-gas source 131 to the gas supply tube 133. By this operation, the compressed gas in a pulsed form is repeatedly supplied, whereby the alloy powder within the hopper 11 is pressed toward the sieve member 113 and gradually falls through the openings of the sieve 114 into the cavities 301 of the container 30 (FIG. 4C). Since the size of the openings formed in this sieve 114 is gradually decreased from the central region (Section A) toward both extremities (Sections D) along the length direction, the fall of the alloy powder from the hopper 11 into the container 30 is impeded by the smaller openings of the sieve 114 in the sections near the extremities, i.e. at the positions near the side wall of the upper opening 111, where the alloy powder will easily fall if the conventional air-tapping method is used. As a result, the filling density of the powder will be approximately uniform across the entire cavity 301.

Figure 4D:
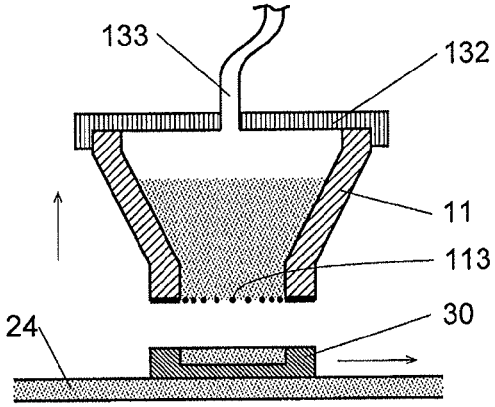

After a predetermined amount of alloy powder has been put into the container 30 by repeating the charge and discharge of the compressed gas for a predetermined period of time, the container 30 is detached from the hopper 11 (FIG. 4D). As a result, the powder held in the container 30 is separated from the powder remaining in the hopper 11, with the sieve member 113 as the boundary. Thus, the operation of filling one container 30 with alloy powder is completed.

(1-3) Modified Example of Grid

Figure 5A:
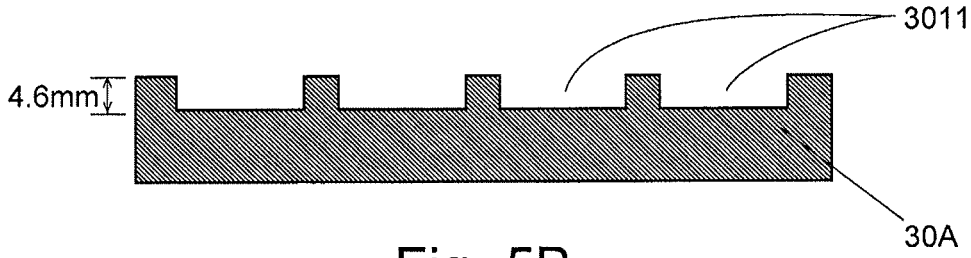
Figure 5B:
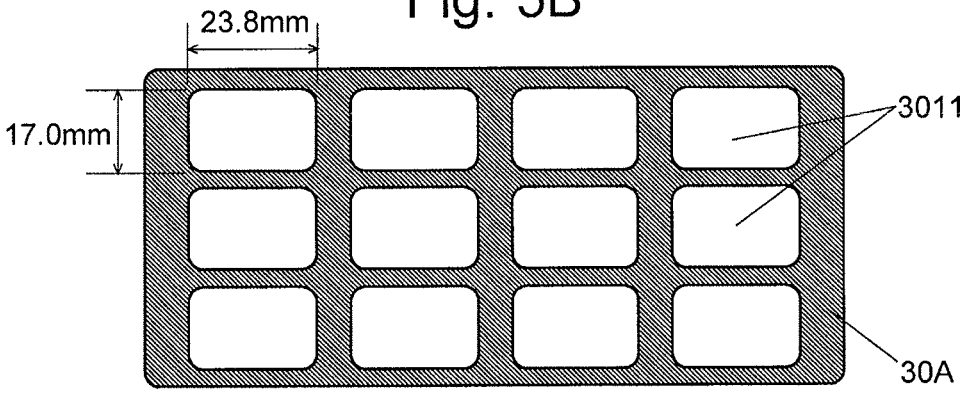
Figure 5C:
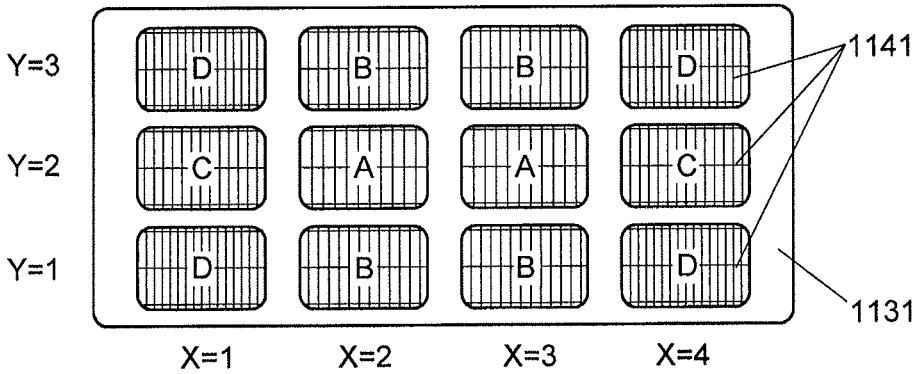
FIG. 5C is a top view of one example of the sieve member used for filling this container with powder.

Using FIG. 5, a sieve member 1131 as a modified example is described. The sieve member 1131 is used to put alloy powder into a container 30A shown in FIGS. 5A and 5B. The container 30A has twelve cavities 3011 arranged in four columns in the length direction and three rows in the width direction at regular intervals, with each cavity having a roughly rectangular-parallelepiped shape measuring 23.8 mm in length, 17.0 mm in width and 4.6 mm in depth (FIG. 5B). Corresponding to those cavities 3011, the sieve member 1131 has twelve sieves 1141 arranged in four columns in the length direction and three rows in the width direction (FIG. 5C).

The size of the openings of the twelve sieves 1141 is set to be uniform within each individual sieve 1141 but vary among the sieves 1141 depending on the distances from the long and short sides of the sieve member 1131, or depending on the distance from the side wall of the lower opening 112 of the hopper 11 to be attached to the upper end of those long and short sides. Specifically, the size of the openings of each sieve 1141 is set as follows: The sieves 1141 which are not adjacent to any of the long and short sides and are separated from the lower opening 112 (i.e. the two sieves labelled "A" in FIG. 5C, which are hereinafter called "sieves A") have a size of 8.0×2.0 mm; those adjacent to the long sides (one face of the side wall) have a size of 8.0×1.8 mm ("sieves B", four); those adjacent to the short sides (the other face of the side wall) have a size of 8.0×1.6 mm ("sieves C", two); and those adjacent to both long and short sides (two faces of the side wall) have a size of 8.0×1.4 mm ("sieves D", four). If the position of each sieve 1141 is defined by X indicating the number of columns counted from one end in the length direction (X=1 to 4) and Y indicating the number of rows counted from one end in the width direction (Y=1 to 3), the position of each sieve 1141 will be as follows:

Sieves A: (X, Y)=(2, 2) and (3, 2)

Sieves B: (X, Y)=(2, 1), (2, 3), (3, 1) and (3, 3)

Sieves C: (X, Y)=(1, 2) and (4, 2)

Sieves D: (X, Y)=(1, 1), (1, 3), (4, 1) and (4, 3)

In the previous description, the sieves 1141 have been labelled as "A" through "D." Similarly, in the following description, the cavities 3011 corresponding to those sieves will be labelled as "cavities A" through "cavities D."

Before the effect of the sieve member 1131 of the modified example is explained, a case for comparison is described in which a conventional sieve member having the same size of openings for all the cavities 3011 is used. If this sieve member is used in the air tapping, the filling density will be highest in "cavities D" adjacent to two faces of the side wall of the lower opening 112 and gradually decrease in the following order: "cavities C" adjacent to the short-side face of the side wall, "cavities B" adjacent to the long-side face of the side wall, and "cavities A" separated from the side wall. This is most likely because the powder located closer to the side wall of the opening of the hopper 11 more easily falls from the hopper into the cavities 3011 due to the same reason as in the case of a single cavity in which the filling density in a region closer the side wall of the opening of the hopper becomes higher than in the central region. As for the difference between cavities B and C, the probable reason is as follows: Both groups of cavities are equal in terms of the distance from the closest face of the side wall of the lower opening 112 (the long-side face for cavities B and short-side face for cavities C). However, in terms of the distance from the second closest face of the side wall (i.e. the short-side face for cavities B and long-side face for cavities C), cavities C are closer to the side wall than cavities B. Therefore, the filling density in cavities C is more likely to be affected by the side wall and becomes higher than in cavities B.

By contrast, when the sieve member 1131 of the present modified example is used, the cavities into which the alloy powder is more likely to fall from the hopper 11 are in contact with the sieves having a smaller size of the openings, so that the movement of the alloy powder into the hopper 11 is impeded at those cavities. Consequently, the filling densities in the cavities 3011 will be equalized.

(2) Embodiment of Sintered Magnet Production System

Figure 6:
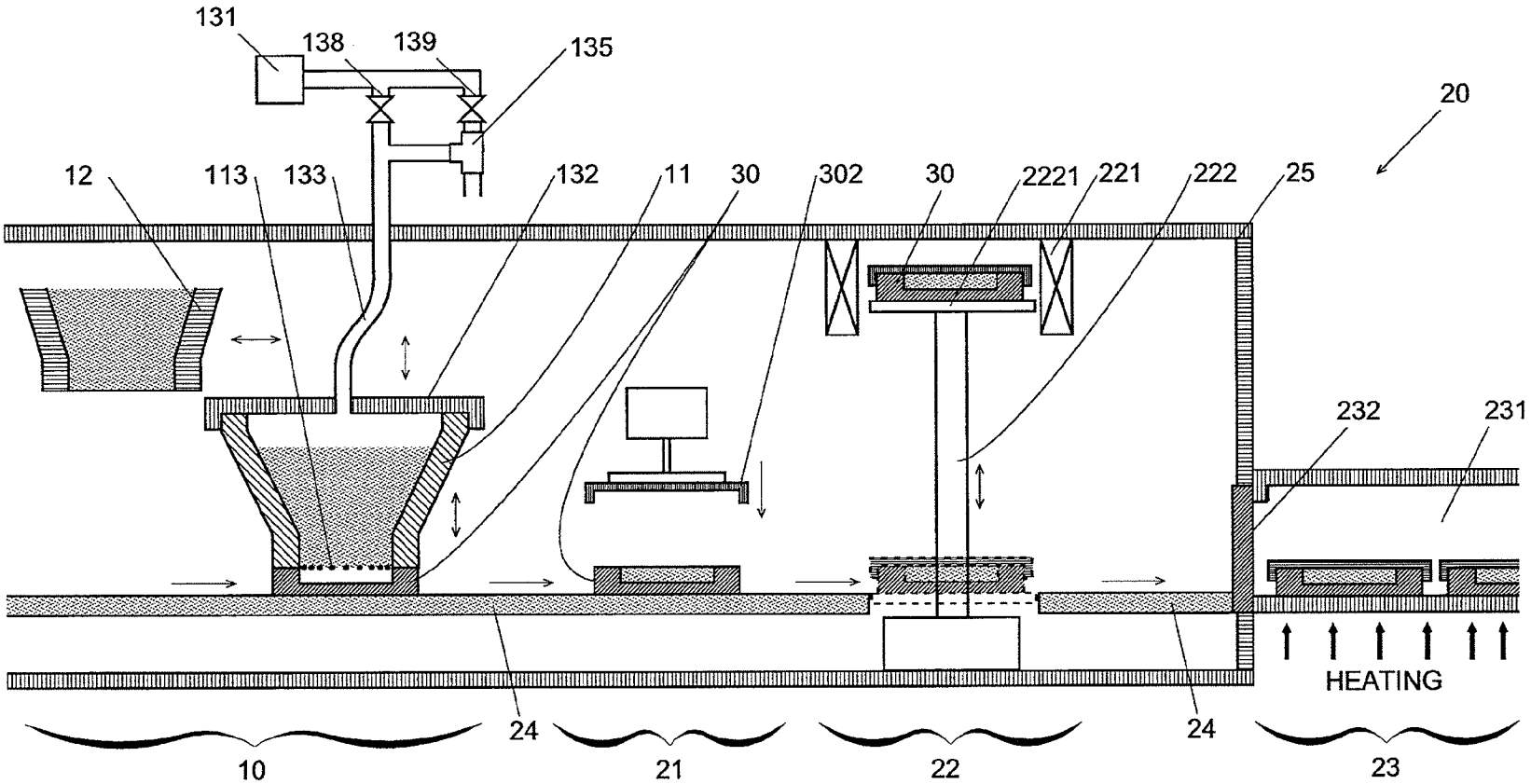
FIG. 6 is a schematic configuration diagram of one embodiment of the sintered magnet production system according to the present invention.

One embodiment of the sintered magnet production system according to the present invention is described using FIG. 6. The sintered magnet production system 20 of the present embodiment is a system for producing a sintered magnet by the press-less method in which alloy powder to be used as the material of the sintered magnet is sintered without being compression-molded.

(2-1) Configuration of Sintered Magnet Production System 20

The sintered magnet production system 20 has a powder-filling system 10, a cover-attaching section 21, an orienting section 22 and a sintering section 23. Furthermore, the sintered magnet production system 20 is provided with a container conveyer (belt conveyer) 24 for sequentially conveying a container 30 to the powder-filling system 10, cover-attaching section 21, orienting section 22 and sintering section 23.

The powder-filling system 10, cover-attaching section 21 and orienting section 22 are contained in a closed chamber 25 which can be filled with inert gas, such as argon or nitrogen gas. It should be noted that, as will be described later, part of the powder-filling system 10 is located outside the closed chamber 25. The sintering section 23 is located outside the closed chamber 25, but as will be described later, it can be filled with inert gas independently of the closed chamber 25.

The powder-filling system 10 has the previously described configuration. It should be noted that some components of the gas supplier 13, exclusive of the entire cover member 132 and a portion of the gas supply tube 133, are placed outside the closed chamber 25 since those components will not directly affect oxidization of the alloy powder.

The cover-attaching section 21 is a system for attaching a cover 302 (which is not the cover member 132 of the powder-filling system 10) to the container 30 filled with the alloy powder by the powder-filling system 10. The cover 302 is used to prevent scattering of the alloy powder due to the magnetic field in the orienting section 22, the convection of gas in the sintering section 23 and other factors.

Figure 7:
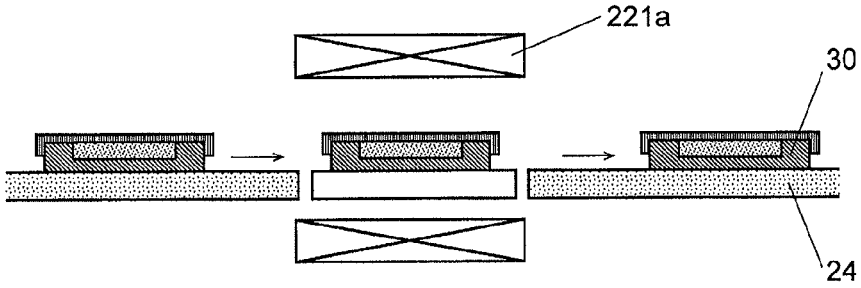
FIG. 7 is a modified example of the orienting section in the sintered magnet production system.

The orienting section 22 has a coil 221 and a container elevator 222. The coil 221 has a substantially vertical axis and is located above the container elevator 222. The container elevator 222 is a system having a stage 2221 which can be vertically moved into or removed from the coil 221, with the container 30 transferred from the container conveyer 24 placed on it. It should be noted that, in the process of orienting the alloy powder in the cavities, the direction of the application of the magnetic field, i.e. the direction of the axis of the coil, must be set according to the shape of the cavities and the intended use of the magnet to be produced. In the present embodiment, the aforementioned configuration is adopted to apply a magnetic field in a substantially vertical direction to the container 30. For example, if the electric field needs to be applied in a substantially horizontal direction, the system may be configured as shown in FIG. 7, in which the axis of the coil 221A is substantially horizontal and the container 30 is directly conveyed into the coil 221A by the container conveyer 24.

The sintering section 23 has a sintering chamber 231 for containing a number of containers 30, a carry-in entrance 232 with a heat-insulating door for allowing the container 30 to be carried from the closed chamber 25 into the sintering chamber 231, a carry-out exit (not shown) for allowing the container 30 to be carried away from the sintering chamber 231, and a heater (not shown) for heating the inside of the sintering chamber 231. The closed chamber 25 and the sintering chamber 231 communicate with each other at the carry-in entrance 232 but can be thermally separated by closing the heat-insulating door. The sintering chamber 231 can be filled with inert gas (independently of the closed chamber 25). The sintering chamber 231 may also be evacuated instead of being filled with inert gas.

(2-2) Operation of Sintered Magnet Production System 20

An operation of the sintered magnet production system 20 is described. Initially, a container 30 is conveyed by the container conveyer 24 to the powder-filling system 10, in which the cavities 301 of the container 30 are filled with alloy powder in the previously described manner. Next, the container 30 is conveyed by the container conveyer 24 to the cover-attaching section 21. The cover-attaching section 21 puts the cover 302 on it.

Then, the container 30 with the cover 302 attached is conveyed by the container conveyer 24 onto the stage 2221 of the orienting section 22. Subsequently, the container 30 placed on the stage 2221 is moved upward by the container elevator 222, to be set within the coil 221. Then, a magnetic field is applied in the vertical direction by the coil 221, whereby the particles of the alloy powder in the cavities 301 are oriented in one direction. Since the cavities 301 in the container 30 used in the present embodiment are designed to produce plate-shaped sintered magnets whose thickness direction corresponds to the vertical direction, the magnetic field is applied in a substantially perpendicular direction to the plate. No mechanical pressure is applied to the alloy powder in the cavities 301 during the application of this magnetic field.

After the application of the magnetic field is completed, the container 30 is lowered by the container elevator 222 from the coil 221 to the level of the container conveyer 24, and is subsequently carried into the sintering chamber 231 by the container conveyer 24. After a predetermined number of containers 30 have been carried into the sintering chamber 231, the door of the carry-in entrance 232 is closed, and the inside of the sintering chamber 231 is heated by the heater to a predetermined sintering temperature (normally, 900 to 1100° C.). By this process, the alloy powder in the cavities 301 is sintered, and sintered magnets are obtained. No mechanical pressure is applied to the alloy powder in the cavities 301 in the sintering section 23 either.

The description thus far is concerned with the case of using the container 30. The sintered magnet production system 20 operates in the same way even if the previously described container 30A is used.

In the sintered magnet production system 20 according to the present embodiment, the cavities 301 can be filled with alloy powder at an approximately uniform density by using the powder-filling system 10, so that the properties of the eventually obtained sintered magnet will be approximately homogeneous regardless of the position in the sintered magnet.

(3) Result of Experiment

Hereinafter shown is the result of an experiment in which RFeB system sintered magnets ($R_2FeB_{14}$, where R is a rare earth) were produced by the sintered magnet production system 20 of the present embodiment, and their residual magnetic flux densities $B_r$ were measured, together with a comparative example. The filling density of the alloy powder in the production process and the residual magnetic flux density $B_r$ have such a relationship that a higher filling density makes the orientation of the alloy-powder particles more difficult and leads to a lower residual magnetic flux density $B_r$. In the following experiments, NdFeB system sintered magnets (i.e. R=Nd) were produced. Similar results will be obtained even if other kinds of RFeB system sintered magnets are produced.

(3-1) First Experiment

Figure 8A:
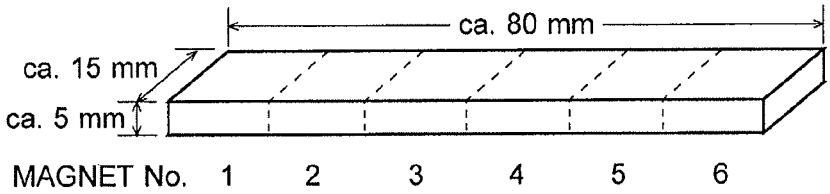
FIG. 8A is a perspective view illustrating a process of obtaining sintered-magnet pieces from a sintered magnet produced by the sintered magnet production system of the present embodiment using the sieve member shown in FIG. 3 or a sintered magnet production system of a comparative example.
Figure 8B:
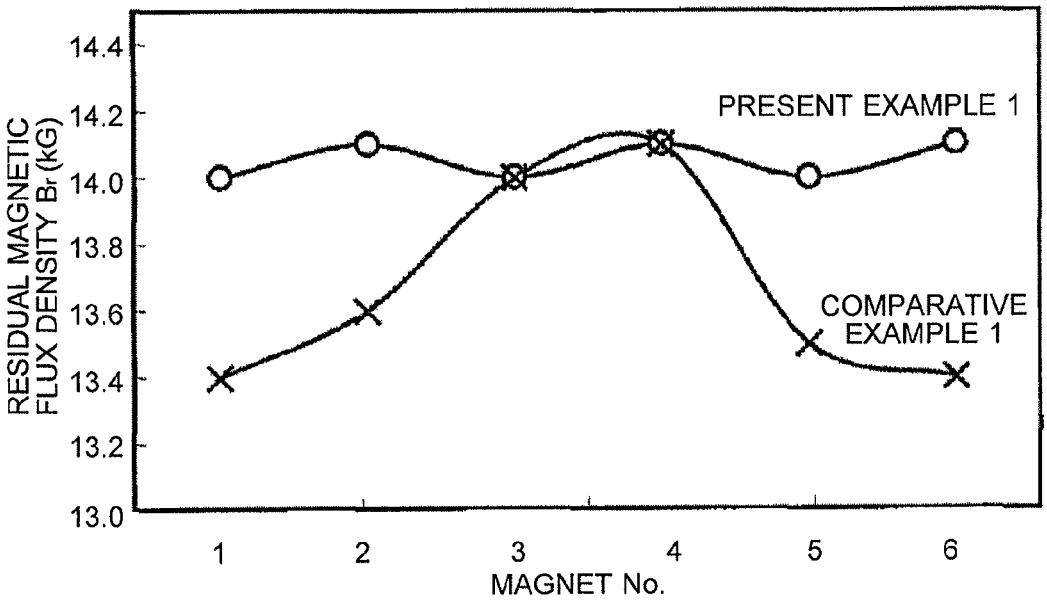
FIG. 8B is a graph showing a measured result of the residual magnetic flux density $B_r$ of the sintered magnets produced by the sintered magnet production systems of the present embodiment and the comparative example.

In the first experiment, a sintered magnet was produced using the sieve member 113 and the container 30 (Present Example 1). Another sintered magnet was also produced using a sieve member having the same size of openings (8.6× 2.2 mm) across the entire grid instead of the sieve member 113, and the container 30 (Comparative Example 1). In both Present Example 1 and Comparative Example 1, the obtained sintered magnets approximately measured 80 mm×15 mm×5 mm and were slightly smaller than the cavity 301 due to shrinkage which occurs during the sintering process. The sintered magnets obtained in Present Example 1 and Comparative Example 1 were each equally divided into six pieces along the length direction. Thus, six sintered-magnet pieces were obtained for each (FIG. 8A). For each of these sintered-magnet pieces, the residual magnetic flux density $B_r$ was measured. The result is shown in FIG. 8B.

In Comparative Example 1, the sintered-magnet pieces near the center in the length direction before the division (labelled as Nos. 3 and 4 in FIG. 8A) had the highest residual magnetic flux densities $B_r$, while those located at both ends in the length direction (Nos. 1 and 6) had the lowest residual magnetic flux densities $B_r$. As explained earlier, a higher filling density leads to a lower residual magnetic flux density $B_r$. Therefore, it can be considered that a density distribution in which the filling density at both ends is higher than at central regions in the length direction was formed in Comparative Example 1.

By contrast, in Present Example 1, while the residual magnetic flux densities $B_r$ of the sintered-magnet pieces near the center in the length direction before the division (Nos. 3 and 4) were almost equal to those of Comparative Example 1, the residual magnetic flux densities $B_r$ of the sintered-magnet pieces at both ends in the length direction (Nos. 1 and 6) were higher than those of Comparative Example 1; the obtained values were close to the residual magnetic flux densities of $B_r$ the sintered-magnet pieces Nos. 3 and 4. The residual magnetic flux densities $B_r$ of the sintered-magnet pieces Nos. 2 and 5 were also higher than those of the sintered-magnet pieces Nos. 2 and 5 in Comparative Example. Furthermore, the variation in the residual magnetic flux density $B_r$ of the sintered-magnet pieces was smaller than in Comparative Example.

Those results of the experiment in Present Example 1 mean that the filling density of the alloy powder in the cavity 301 in the production process was closer to uniformity than in Comparative Example. This result agrees with the previous explanation based on the influence of the side wall of the hopper.

(3-2) Second Experiment

Figure 9:
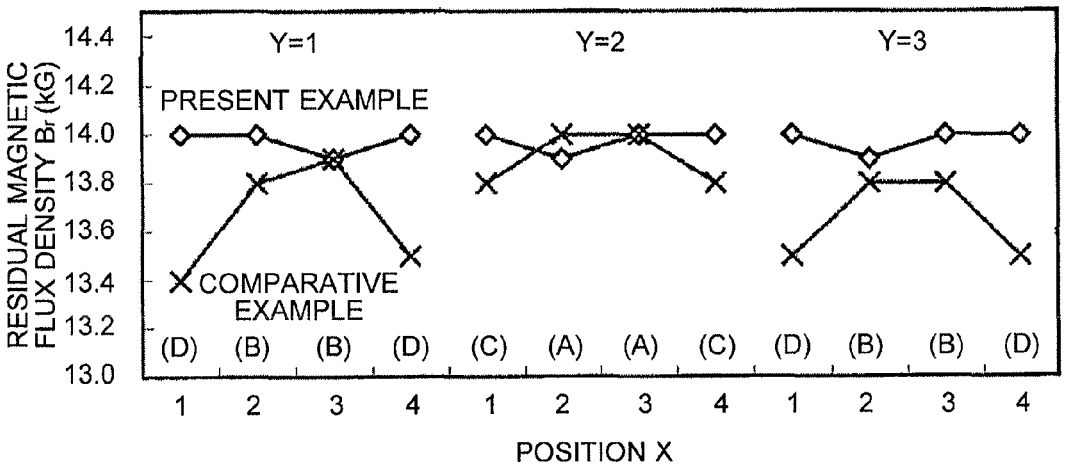
FIG. 9 is a graph showing a measured result of the residual magnetic flux density $B_r$ of sintered magnets produced by using the sintered magnet production system of the present embodiment having the sieve member shown in FIG. 5C and the sintered magnet production system of the comparative example.

In the second experiment, a sintered magnet was produced using the sieve member 1131 and the container 30A (Present Example 2). Another sintered magnet was also produced using a sieve member having the same size of openings (8.0× 2.0 mm) across the entire sieve instead of the sieve member 1131, and the container 30A (Comparative Example 2). In both Present Example 2 and Comparative Example 2, twelve pieces of sintered magnets were obtained from the alloy powder placed in the twelve cavities of the container 30A. FIG. 9 shows the measured result of the residual magnetic flux density $B_r$ for each sintered magnet.

In Comparative Example 2, the distribution of the residual magnetic flux density $B_r$ was such that the sintered magnets produced from the alloy powder placed in the cavities corresponding to sieves A (FIG. 5C) had the highest residual magnetic flux densities $B_r$, followed by sieves B, C (no difference could be recognized between B and C at the precision of the present experiment) and D. Accordingly, the cavity-filling density in the production process is highest at cavities D, second highest at cavities B and C, and lowest at cavities A.

By contrast, in Present Example 2, the residual magnetic flux densities $B_r$ obtained for cavities A were roughly equal to those in Comparative Example 2, while the values obtained for cavities B-D were higher than the corresponding values in Comparative Example 2. Furthermore, the variation in the residual magnetic flux density $B_r$ was smaller than in Comparative Example 2. Accordingly, it can be considered that the variation of the filling density among the cavities in Present Example 2 is smaller than in Comparative Example 2. This result agrees with the previous explanation based on the influence of the side wall of the hopper.

REFERENCE SIGNS LIST

10 . . . Powder-Filling System
11 . . . Hopper
111 . . . Upper Opening
112 . . . Lower Opening
113, 1131 . . . Sieve Member
114, 1141 . . . Sieve
12 . . . Powder Supplier

121 . . . Storage Unit
122 . . . Powder Discharge Opening
13 . . . Gas Supplier
131 . . . Compression-Gas Source
132 . . . Cover Member
133 . . . Gas Supply Tube
134 . . . Branch Tube
135 . . . Aspirator
135A . . . Passage Tube
135B . . . Suction Tube
136 . . . First Branching Section
137 . . . Second Branching Section
138 . . . First Valve
139 . . . Second Valve
20 . . . Sintered Magnet Production System
21 . . . Cover-Attaching Section
22 . . . Orienting Section
221, 221A . . . Coil
222 . . . Container Elevator
2221 . . . Stage of Container Elevator
23 . . . Sintering Section
231 . . . Sintering Chamber
232 . . . Carry-in Entrance
24 . . . Container Conveyer
25 . . . Closed Chamber
30, 30A . . . Container
301, 3011 . . . Cavity
302 . . . Container Cover

The invention claimed is:

1. A system for filling a container with powder, including:

a) a hopper for holding the powder, the hopper having an opening configured to be attached to the container in a removable and hermetically closable fashion so that the hopper communicates with the container at the opening for supplying the powder to the container;

b) a powder supplier for supplying the powder to the hopper;

c) a gas supplier for repeatedly supplying compressed gas in a pulsed form to the hopper, with the hopper attached to the container in a hermetically closed fashion; and d) a sieve member provided at the opening, the sieve member having a smaller openings in a region near a side wall of the hopper than in a central region of the hopper.

2. The powder-filling system according to claim 1, wherein:

the container has a plurality of cavities to be filled with the powder; and the hopper is configured to be attached to the container so that the hopper is hermetically closed while communicating with the plurality of cavities.

3. A sintered magnet production system, comprising:

1) a powder-filling device for filling a container with alloy powder to be used as a material of a sintered magnet, the powder-filling device having:

a) a hopper for holding the alloy powder, the hopper having an opening configured to be attached to the container in a removable and hermetically closable fashion so that the hopper communicates with the container at the opening for supplying the alloy powder to the container;

b) a powder supplier for supplying the alloy powder to the hopper;

c) a gas supplier for repeatedly supplying compressed inert gas in a pulsed form to the hopper, with the hopper attached to the container in a hermetically closed fashion; and d) a sieve member provided at the opening, the sieve member having a smaller openings in a region near a side wall of the hopper than in a central region of the hopper;

2) an orienting device for orienting the alloy powder by applying a magnetic field to the alloy powder while holding the alloy powder in the container without applying a mechanical pressure;

3) a sintering device for sintering the alloy powder by heating the alloy powder while holding the alloy powder in the container without applying a mechanical pressure; and 4) a casing for containing the powder-filling device, the orienting device and the sintering device in an oxygen-free atmosphere.

4. The sintered magnet production system according to claim 3, wherein:

the container has a plurality of cavities to be filled with the powder; and the hopper is configured to be attached to the container so that the hopper is hermetically closed while communicating with the plurality of cavities.

* * * * *